United States Patent [19]

Yamaguchi et al.

[11] Patent Number: 4,679,575

[45] Date of Patent: Jul. 14, 1987

[54] CIGARETTE

[75] Inventors: Katsunori Yamaguchi, Kawasaki; Nagaaki Takemoto, Tokyo, both of Japan

[73] Assignee: Japan Tobacco Inc., Tokyo, Japan

[21] Appl. No.: 758,641

[22] PCT Filed: Sep. 3, 1984

[86] PCT No.: PCT/JP84/00420

§ 371 Date: Jul. 8, 1985

§ 102(e) Date: Jul. 8, 1985

[87] PCT Pub. No.: WO86/01377

PCT Pub. Date: Mar. 13, 1986

[51] Int. Cl.[4] ..... A24D 1/02; A24F 1/00

[52] U.S. Cl. ..... 131/365; 131/331; 131/360

[58] Field of Search ..... 131/352, 365, 331, 360

[56] References Cited

U.S. PATENT DOCUMENTS

| | | | |
|---|---|---|---|
| 4,033,359 | 7/1977 | Borthwick et al. | 131/352 |
| 4,231,377 | 11/1980 | Cline et al. . | |
| 4,452,259 | 6/1984 | Norman et al. | 131/365 |

FOREIGN PATENT DOCUMENTS

| | | |
|---|---|---|
| 48-44500 | 6/1973 | Japan . |
| 48-61699 | 8/1973 | Japan . |
| 50-135298 | 10/1975 | Japan . |
| 55-114279 | 9/1980 | Japan . |
| 57-163479 | 10/1982 | Japan . |

*Primary Examiner*—V. Millin

*Attorney, Agent, or Firm*—Schwartz, Jeffery, Schwaab, Mack, Blumenthal & Evans

[57] ABSTRACT

A cigarette which produces a decreased amount of tar when being smoked. In the cigarette (10) of the invention, a fire-retarding agent is present inside or on the outer surface of a rolling material (14), and a combustion promoter is present in shredded tobacco (12) or on the inner surface of the rolling material (14).

8 Claims, 4 Drawing Figures

CIGARETTE

TECHNICAL FIELD

The present invention relates to cigarettes. More particularly, the present invention relates to cigarettes which have lower tar contents in the main and sub smoke flows without changing the number of puffs per cigarette and the air permeation amount of the rolling material during smoking.

BACKGROUND ART

Techniques for reducing the sub smoke flow in cigarette smoking are known as per U.S. Pat. No. 4,231,377 and Japanese Patent Disclosure (Kokai) No. 57-163,479. A technique for reducing the main and sub smoke flows in cigarette smoking is known as per Japanese Patent Disclosure (Kokai) No. 48-61, 699.

In U.S. Pat. No. 4,231,377, a magnesium compound such as magnesia or magnesium hydroxide is added to rolling material to reduce the sub smoke flow. This patent does not provide any description of the main smoke flow.

In Japanese Patent Disclosure (Kokai) No. 57-163,479, the sub smoke flow is reduced using a rolling material having a small amount of air permeation (about 0.5 to 8 coresta). However, this technique has its disadvantages of increase in the main smoke flow and the number of puffs.

Japanese Patent Disclosure (Kokai) No. 48-61,699 discloses wrapping shredded tobacco with two rolling materials. The first rolling material directly wraps the shredded tobacco and is added with up to 70%, based on the first rolling material, of activated carbon having a particle size of 0.177 mm or less and containing particles having a size of 0.44 mm or less in an amount of 25 to 50%. The second rolling material consists of general cigarette paper and covers the first rolling material. These two rolling materials reduce the main and sub smoke flows. However, according to this method, the thickness of the rolling material is increased and interferes with the rolling operation of a conventional cigarette making machine. This leads to a need for a modified cigarette making machine or the development of a new type of cigarette making machine. Even if rolling with a conventional cigarette making machine can be performed, activated carbon may be separated or peeled off during rolling, thus adversely affecting the rolling conditions. This also renders maintenance of the cigarette making machine difficult.

DISCLOSURE OF INVENTION

It is an object of the present invention to provide cigarettes which when being smoked produce a reduced amount of tar without substantially changing the number of puffs and the air permeation amount of the rolling material.

It is another object of the present invention to provide cigarettes which produce a reduced amount of tar when being smoked without requiring a significant change in cigarette making procedures or without adversely affecting environmental conditions during cigarette making.

In order to achieve these objects, there is provided a cigarette having shredded tobacco and rolling material wrapping it, wherein a fire-retarding agent is present in the rolling material or on an outer surface of the rolling material, and a combustion promoter is present in the shredded tobacco or on an inner surface of the rolling material.

The cigarette according to the present invention has substantially the same number of puffs and air permeation of the rolling material during smoking as conventional cigarettes and can be manufactured by substantially the same method as that of conventional cigarettes, produces less amount of tar when being smoked than conventional cigarettes.

BEST MODE FOR CARRYING OUT THE INVENTION

Figure 1:
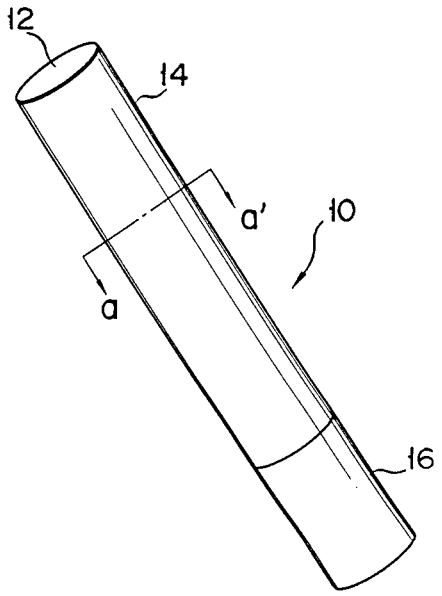
FIG. 1 is a perspective view of a cigarette according to an embodiment of the present invention.

As shown in FIG. 1, the cigarette 10 according to the present invention has the same outer appearance as that of a conventional cigarette. That is, the cigarette 10 has shredded tobacco 12 and a rolling material 14 wrapping it. The rolling material is a sheetlike material used for encircling shredded tobacco and usually consists of paper. A tobacco leaf of a cigar is also a rolling material. A filter plug 16 is generally arranged at one end of a cigarette. In the cigarette of the present invention, a fire-retarding agent is present in the rolling material 14 or on its outer surface, and a combustion promoter is present in the shredded tobacco 12 or on the inner surface of the rolling material 14.

Examples of the fire-retarding agent may include carbohydrates; inorganic substances such as antimony-containing compounds, ammonium phosphate and ammonium sulfamate; phosphorous-containing compounds such as lower alkyl phosphate and hydroxymethyl phosphonium; bromine or chlorine-containing compounds; and mixtures thereof. Among these examples, carbohydrates are particularly preferable. Particularly preferable examples of carbohydrates are cellulose derivatives such as carboxy methyl cellulose; gums such as gum arabic; pectines; or starches.

The fire-retarding agent is contained in the rolling material or is applied on the outer surface of the rolling material. The fire-retarding agent can be added to the rolling material, in the manufacture of rolling paper, by adding it to liquid pulp immediately before forming into paper. The fire-retarding agent can be applied on the surface of the rolling material by dissolving it in a suitable solvent such as water and spraying the surface of the rolling material with the resulant solution.

The amount of the fire-retarding agent to be used is about 0.1 to 30% and preferably 1 to 20% with respect to the weight of the rolling material.

Examples of the combustion promoter may include alkaline metal salts or alkali earth metal salts of nitric acid, tartaric acid, phosphoric acid, fumaric acid and citric acid.

The combustion promoter is added to the shredded tobacco or is coated on the inner surface of the rolling material. Addition of the combustion promoter to the shredded tobacco or coating of the surface of the rolling material therewith can be performed by dissolving it in a suitable solvent such as water and spraying the shredded tobacco or rolling material with the resulant solution.

The amount of the combustion promoter to be used is 0.1 to 50% and preferably 1 to 35% with respect to the weight of the rolling material.

Figure 2:
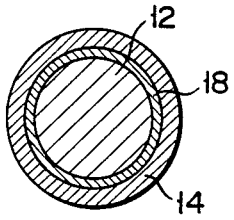
FIGS. 2 to 4 are enlarged sectional views along the line a—a' in FIG. 1 for illustrating various embodiments of the present invention.
Figure 3:
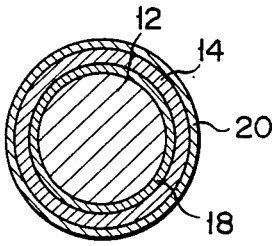
Figure 4:
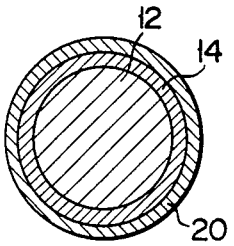

The cigarette according to the present invention can be one as shown in FIG. 2 wherein a combustion promoter 18 is coated on the inner surface of a rolling material 14, and a fire-retarding agent is contained in the rolling material 14. The fire-retarding agent can be added in the rolling material, and the combustion promoter can be added in shredded tobacco. Alternatively, as shown in FIG. 3, a fire-retarding agent 20 can be coated on the outer surface of a rolling material 14, and a combustion promoter 18 can be coated on the inner surface of the rolling material 14. Still alternatively, as shown in FIG. 4, a fire-retarding agent 20 can be coated on the outer surface of a rolling material 14, and a combustion promoter can be added to the shredded tobacco 12.

The relationship between an addition of a fire-retarding agent and the combustibility of the rolling material was examined. The combustibility of the rolling material was tested in accordance with the flame contact method of the combustibility test method D of fiber materials according to the Japanese Industrial Standard JIS-L1091. A rolling material having a length of 200 mm and a width of 27 mm was wrapped around a cylinder with an outer diameter of 8 mm such that the rolling material cylinder had a length of 100 mm. The cylinder was placed in a stainless steel coil which had an inner diameter of 10 mm, a line diameter of 0.5 mm and a line pitch of 2 mm, and which was inclined at an angle of 45 degrees with respect to a horizontal plane. The lower end of this sample was brought into contact with a burner flame and 90% of the cylindrical rolling material was burnt into ash. The number of contacts of the sample with the flame of burner to burn 90% of the rolling material was observed. The above operation was repeated five times to calculate the average number of contacts of the sample with the flame as an index of the combustibility of the rolling material. The type and amount (% by weight with respect to the weight of the rolling material) of the fire-retarding agent are shown in Table 1 below. The test results are also shown in the table.

TABLE 1

| Fire-retarding agent | Amount | Average No. of contact with flame |
|---|---|---|
| carboxymethyl cellulose | 2.9 | 4.7 |
| carboxymethyl cellulose | 8.3 | 9.3 |
| carboxymethyl cellulose | 9.8 | 15.0 |
| gum arabic | 2.0 | 1.5 |
| gum arabic | 5.3 | 3.5 |

TABLE 1-continued

| Fire-retarding agent | Amount | Average No. of contact with flame |
|---|---|---|
| — (Control) | — | 1.0 |

It is seen from Table 1 above that when the fire-retarding agent is added, the number of contact of the sample with the flame is increased, and the combustibility is impaired.

EXAMPLE

Five types of filter cigarette samples A to E of standard size according to the present invention were prepared. Each of these cigarettes had a rolling portion (the cigarette from which the filter is removed) of 63 mm length, an acetate filter of 17 mm length (overall length: 80 mm), and an outer circumferential length of the rolling portion of 25 mm. A control cigarette sample F of general type was also prepared to provide a total of 6 types of cigarettes. The samples were subjected to the smoking test according to the following method. The tar contents in the main and sub smoke flows were examined. The types and amounts (% by weight) of the fire-retarding agent and the combustion promoter in each sample and methods of adding them are shown in Table 2 below. The air permeation amount and combustibility (average number of contact of the sample with the flame and the average combustion speed (mm/sec)) of each rolling material are also shown in Table 2. The air permeation amount of the rolling material is expressed in units of coresta which represent the amount of air (ml) which is passed through an area of 1 $cm^2$ of the rolling material at a differential pressure of 100 $mmH_2O$.

Each sample was mounted in an automatic smoking machine and was smoked under standard conditions. The automatic smoking machine was of a type which can separately collect tars in the main and sub smoke flows produced during smoking. The standard conditions mean a combustion length of 50 mm, a smoking frequency of once/min, a smoking volume of 35 ml/puff, and a smoking time of 2 sec/puff. The tar was collected with a Cambridge filter and the amount of the tar was measured by substracting the water content from the weight difference of the Cambridge filter before and after tar collection. Five samples were tested each time with the automatic smoking machine, and this cycle was repeated three times. The average amount of tar in terms of weight per gram of the cigarette was calculated. The tar contents in the main and sub smoke flows and the average number of puffs are shown in Table 3 below.

TABLE 2

| | Fire-retaring agent | | | Combustion promoter | | | Air | Combustibility of rolling material | |
|---|---|---|---|---|---|---|---|---|---|
| Sample | Type | Adding method | Amount | Type | Adding method | Amount | permeation amount | Average No. of contact with flame | Average combustion speed |
| A | carboxy-methyl cellulose | Applied on outer surface of rolling material | 4.5 | potassium nitrate | Applied on inner surface of rolling material | 15.6 | 12 | 1 | 2.20 |
| B | carboxy-methyl cellulose | Applied on outer surface of rolling material | 2.8 | potassium nitrate | Applied on inner surface of rolling material | 1.2 | 11 | 1 | 2.27 |
| C | carboxy- | Applied | 1.0 | sodium | Applied | 3.0 | 12 | 1 | 1.00 |

TABLE 2-continued

| Sample | Fire-retaring agent | | | Combustion promoter | | | Air permeation amount | Combustibility of rolling material | |
|---|---|---|---|---|---|---|---|---|---|
| | Type | Adding method | Amount | Type | Adding method | Amount | | Average No. of contact with flame | Average combustion speed |
| | methyl cellulose | on outer surface of rolling material | | fumarate | on inner surface of rolling material | | | | |
| D | carboxy-methyl cellulose | Added in rolling material | 20.0 | potassium nitrate | Applied on inner surface of rolling material | 30.5 | 13 | 1 | 1.15 |
| E | gum arabic | Applied on outer surface of rolling material | 3.8 | sodium citrate | Added in shredder tobacco | 5.2 | 9 | 2 | — |
| F | — (Control) | — | — | — | — | — | 13 | 1 | 0.88 |

TABLE 3

| Sample | Average tar amount in smoke (mg/g) | | | Average No. of puffs |
|---|---|---|---|---|
| | Main smoke flow | Sub smoke flow | Total | |
| A | 28.0 | 18.0 | 46.0 | 13.0 |
| B | 31.0 | 26.2 | 57.2 | 10.0 |
| C | 32.2 | 27.0 | 59.2 | 9.2 |
| D | 29.1 | 12.1 | 41.2 | 10.3 |
| E | 32.0 | 28.1 | 60.0 | 10.3 |
| F | 33.9 | 31.8 | 65.7 | 10.5 |

As can be seen from Table 3, as compared to sample F, with samples A to E of the present invention, the tar contents in both the main and sub smoke flows, particularly, the tar content in the sub smoke flow which is considered to be more injurious to health, is significantly decreased. The average numbers of puffs of samples A to E of the present invention are substantially the same as that of the sample F. Particularly, with samples A and D, the tar contents in the main and sub smoke flows are about 15% and 50% lower than those of sample F, respectively.

We claim:

1. A cigarette comprising:

shredded tobacco;

a rolling material wrapping said shredded tobacco;

a fire-retarding agent contained in said rolling material or coated on the outer surface of said rolling material; and a combustion promoter coated on the inner surface of said rolling material.

2. The cigarette according to claim 1, wherein said fire-retarding agent is present in an amount of about 0.1 to 30% based on the weight of said rolling material.

3. The cigarette according to claim 2, wherein said fire-retarding agent is present in an amount of 1 to 20% based on the weight of said rolling material.

4. The cigarette according to claim 1, wherein said combustion promoter is present in an amount of 0.1 to 50% based on the weight of said rolling material.

5. The cigarette according to claim 4, wherein said combustion promoter is present in an amount of 1 to 35% based on the weight of said rolling material.

6. The cigarette according to claim 1, further comprising a filter plug provided at one end of said cigarette.

7. The cigarette according to claim 1, wherein the combination of said fire-retarding agent and combustion promotor is such that, when the cigarette is smoked, the amount of tar in main and sub smoke flows is reduced without substantially changing the number of puffs.

8. The cigarette according to claim 1, wherein the fire-retarding agent is one member selected from the group consisting of cellulose derivatives, pectines, gums, and starches, and the combustion promoter is a member selected from the group consisting of alkali metal salts and alkaline earth metal salts of nitric acid, tartaric acid, phosphoric acid, fumaric acid, and citric acid.

* * * * *